US006533041B1

(12) United States Patent
Jensen

(10) Patent No.: US 6,533,041 B1
(45) **Date of Patent: *Mar. 18, 2003**

(54) FIRE SPRINKLER APPARATUS AND METHOD

(75) Inventor: Raymond H. Jensen, Wayne, PA (US)

(73) Assignee: Anvil International, Inc., Portsmouth, NH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 348 days.

(21) Appl. No.: 09/150,422

(22) Filed: Sep. 9, 1998

(51) Int. Cl.[7] ..... A62C 35/58
(52) U.S. Cl. ..... 169/37
(58) Field of Search ..... 169/37

(56) References Cited

U.S. PATENT DOCUMENTS 4,007,877 A * 2/1977 Jackson et al. ..... 169/37 X
4,618,002 A * 10/1986 Mears ..... 169/37
4,770,251 A * 9/1988 Sweet ..... 169/37
4,834,186 A * 5/1989 Ballard ..... 169/37 X
5,447,338 A * 9/1995 Kikuchi ..... 169/37 X
5,743,337 A * 4/1998 MacDonald, III ..... 169/37 X

* cited by examiner

*Primary Examiner*—Robert M. Fetsuga
(74) *Attorney, Agent, or Firm*—John F. A. Earley; John F. A. Earley, III; Harding, Earley, Follmer & Frailey

(57) ABSTRACT

Fire sprinkler apparatus (11) for use with a drop ceiling (13) of suspended tile (15) or sheetrock having a branch or run pipe (17), and a sprinkler head (26) connected to said branch or run pipe (17) by a drop nipple-reducing coupling assembly (29) which comprises a drop nipple (21), a reducing coupling (25) mounted on the bottom end (21*b*) of the drop nipple (21), a weld (27) joining the upper end (25*b*) of the reducing coupling (25) to the bottom end (21*b*) of the drop nipple (21) with the outer circumference of the reducing coupling (25) being the same size as the outer circumference of the drop nipple (21), and an escutcheon fitting (33) which slides over the drop nipple-reducing coupling assembly (29) for a predetermined distance until it is flush with the bottom surface of the tile (15).

7 Claims, 2 Drawing Sheets

FIRE SPRINKLER APPARATUS AND METHOD

BACKGROUND OF THE INVENTION

1. Field of the Invention

This invention relates to fire sprinkler apparatus for use with a drop ceiling of suspended tile or sheetrock, and more particularly concerns a combination pipe drop nipple and reducing coupling used to connect a branch or run pipe extending horizontally parallel to and positioned above a drop ceiling to a sprinkler head mounted beneath the drop ceiling.

2. Description of the Prior Art

The typical apparatus presently employed by fire sprinkler contractors includes a drop nipple which delivers water from a branch pipe to a sprinkler head that is arranged to fit flush against the underside of a suspended ceiling tile or sheetrock ceiling. The drop nipple is threaded on both ends, with one end screwed into a threaded outlet connection on the branch pipe which runs parallel to the unfinished drop ceiling and is positioned above it. The sprinkler head is mounted on the bottom end of the drop nipple and is arranged to fit flush against the underside of the suspended ceiling tile. This arrangement is labor intensive. The sprinkler installer must make two threaded connections to the drop nipple, one at the top portion of the drop nipple and one at the bottom portion of the drop nipple before the suspended ceiling is installed. Following installation of the suspended tile ceiling by the ceiling installer, the sprinkler installer must return to cut the drop nipple to allow the sprinkler head to fit flush against the underside of the ceiling tiles. Also, many parts are required to complete the typical assembly: i.e., the drop nipple threaded at top and bottom portions; a threaded reducing coupling for reducing the one inch inside diameter of the drop nipple to the one half inch inside diameter thread on the sprinkler head; a two-piece escutcheon assembly which is mounted on the reducing coupling and which receives the sprinkler head and permits the second part of the escutcheon to receive a flanged decorative cover to cover the hole in the ceiling tile, and, of course, the sprinkler head itself.

SUMMARY OF THE INVENTION

The present invention is unique. The outside diameter of the reducing coupling has the same outside diameter as the drop nipple. In the present invention, the reducing coupling is welded to the drop nipple to form an integral drop nipple-reducing coupling assembly. Following weld attachment, the outside circumference of the combination drop nipple-reduction coupling assembly is finished by polishing from the coupling end back a predetermined distance, thereby making the assembly appear to be seamless. The finished end may be painted, plated, or polished for decorative purposes. An escutcheon fitting is arranged to slide over the coupling and along the pipe for a predetermined distance to conceal the hole in the ceiling tile through which the assembly is inserted.

When installed, the drop nipple-reducing coupling assembly is screwed into the outlet fitting of the branch pipe so that the drop nipple-reducing coupling assembly protrudes downwardly at 90° from the branch pipe. The length of the drop nipple is arranged to permit it to protrude below the level of the finished drop ceiling tile. Typically, the ceiling tiles are installed by the ceiling installer after the installation of the rough sprinkler piping, of which the drop nipple is a part, by the sprinkler installer.

During the finishing stages of the installation of the invention and the fire sprinkler apparatus and the drop ceiling, the sprinkler head is attached to the combined drop nipple-reducing coupling assembly. An escutcheon fitting is then slid over the water deflector on the sprinkler head which is there for the purpose of creating a spray in the event of a fire. The escutcheon fitting is slid along the finished portion of the drop nipple-reducing coupling assembly to a point which allows the escutcheon fitting to fit flush against the ceiling tiles.

While the ceiling tiles appear to be flat or parallel to the floor of the building, in practice it is typically uneven and wavy. Accordingly, the escutcheon fitting intersects the finished portion of the drop nipple-reducing coupling assemblies at different positions.

The advantages of the invention over the typical fire sprinkler apparatus installation include the following:

1) With the conventional and typical threaded drop nipple, reducer, and escutcheon approach, the sprinkler installer must return to the job following installation of the ceiling tile to remove, cut, and reinstall the drop nipple and reducer so that the escutcheon plate fits flush against the underside of the ceiling tile or sheetrock.

The present invention allows the ceiling tile installer to cut the hole in the ceiling tile so that the combined drop nipple-reducer coupling is positioned in the hole and protrudes below the ceiling tile and this does not require the services of the sprinkler installer. Then the ceiling tile installer can slide the escutcheon fitting over the combined drop nipple-reducer coupling assembly in a manner to allow the escutcheon fitting to fit flush against the ceiling to conceal the hole.

In cases where the sprinkler head is attached to the drop nipple-reducer coupling assembly before the ceiling tile is installed, the tile installer may also slide the escutcheon fitting over the sprinkler head and the drop nipple-reducer coupling assembly so that it fits flush against the ceiling.

So all comeback labor previously required of the sprinkler installer for the typical method of installation is eliminated.

2) The invention reduces the cost of installation of the fire sprinkler apparatus. Instead of the many pieces required by the typical conventional method of installation, the invention reduces the installation pieces to three pieces, the integral drop nipple-reducing coupling assembly, the sprinkler head, and the escutcheon fitting, thereby reducing the cost of raw material required for installation of the fire sprinkler apparatus.

DETAILED DESCRIPTION OF THE DRAWINGS

Figure 1:
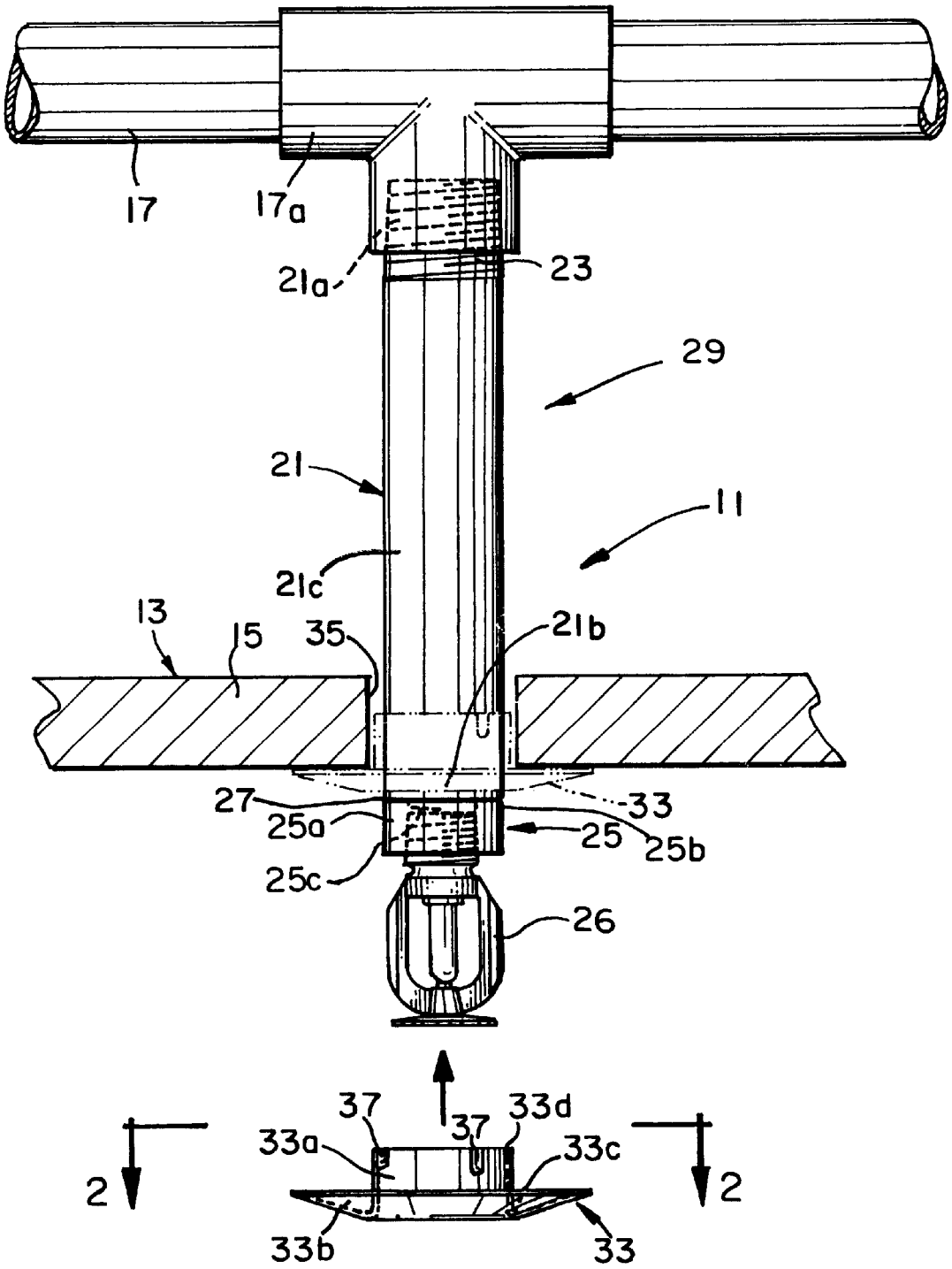
FIG. 1 is a view in side elevation and partly exploded of the drop nipple-reducing coupling of this invention installed in sprinkler apparatus in a drop ceiling.
Figure 3:
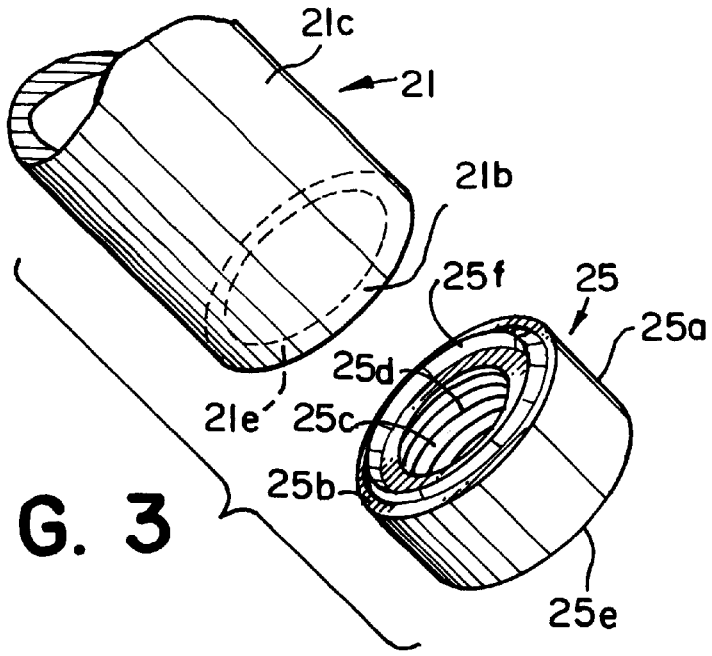
FIG. 3 is a view in perspective of an exploded view of the drop nipple-reducing coupling.
Figure 2:
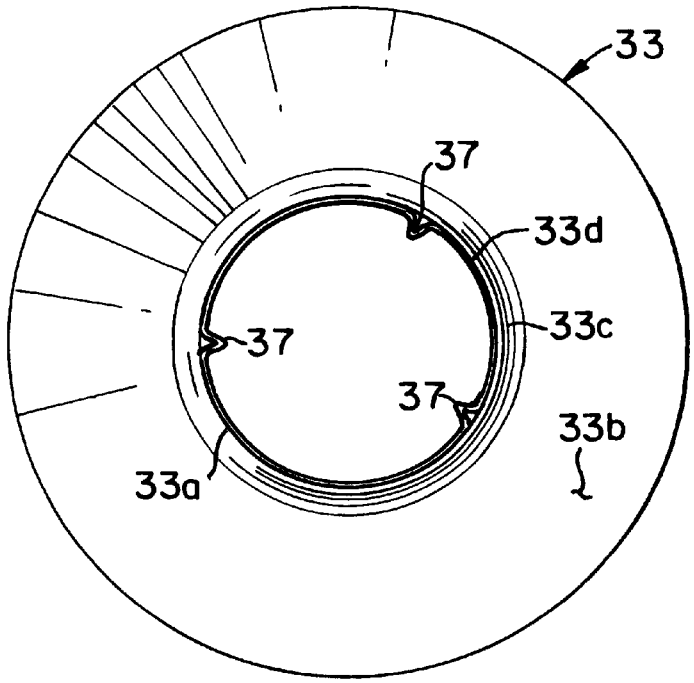
FIG. 2 is a view in bottom plan of an escutcheon fitting.

Turning now to the drawings, there is shown a fire sprinkler apparatus 11 for use with a drop ceiling 13 of suspended tiles 15 or sheetrock which comprises a branch or run pipe 17 extending horizontally parallel to and positioned above the ceiling 13. A drop nipple 21 has threads 23 formed on its upper end 21*a* on the outside surface of the drop nipple 21 which screw into a connecting tee 17*a*. The bottom end 21*b* of drop nipple 21 is free of threads.

A reducing coupling 25 is mounted on the bottom end 21*b* of the drop nipple 21 with the outer surface 25*a* of the reducing coupling 25 and the outer surface 21*c* of the drop nipple 21 being in alignment with each other.

A weld 27 joins the upper end 25*b* of the reducing coupling 25 to the bottom end 21*b* of the drop nipple 21 with the outer circumference of the reducing coupling 25 being the same size as the outer circumference of the drop nipple 21.

A circular ridge 25*f* extends from the upper end surface 25*b* of the reducing coupling 25 and is melted when the reducing coupling 25 and the drop nipple 21 are welded together by a projection type resistance welding operation.

The inside of the reducing coupling 25 is provided with threads 25*c* which are adapted to receive the threads of a sprinkler head 26. In a preferred embodiment of the invention, the nominal diameter of the drop nipple 21 is one inch and the nominal diameter of the reducing coupling 25 is one half inch or three-quarter inch.

The weld 27 joining the top of the reducing coupling 25 to the bottom of the drop nipple 21 forms an integral drop nipple-reducing coupling assembly 29.

The sprinkler head 26 is threaded onto the integral drop nipple-reducing coupling assembly 29, and an escutcheon fitting 33 slides over the nipple-coupling assembly 29 a predetermined distance to fit flush against the tile 15.

The ceiling tile 15 is provided with a hole 35, and the integral drop nipple-reducing coupling assembly 29 extends through the hole 35. The escutcheon fitting 33 fits flush against the bottom of the ceiling tile 15 to hide the hole 35.

The integral combination pipe drop nipple and reducing coupling assembly 29 comprises a drop nipple 21 with threads 23 formed on the outer surface of its upper end 21*a* for connecting to an outlet tee 17*a* in the run pipe 17, and a reducing coupling 25 having an inlet port 25*d* and an outlet port 25*e* with the inner diameter of the inlet port 25*d* being smaller in diameter than the inner diameter of the drop nipple 21. The weld 27 connects the top of the reducing coupling 25 to the bottom of the drop nipple 21 to form the integral drop nipple-reducing coupling assembly 29, and the inner circumference of the reducing coupling 25 of assembly 29 has threads formed thereon. The outer circumference of the sprinkler head 26 has outer threads which screw into the inner threads of the reducing coupling 25.

The method of making and using the combination drop nipple and reducing coupling assembly 29 for use in fire sprinkler apparatus 11 includes the steps of selecting a pipe of suitable size to form a drop nipple 21, and cutting threads 23 into the upper portion of the drop nipple 21 suitable for connecting the drop nipple 21 to an outlet tee 17*a* in branch or run pipe 17. Then selecting a reducing coupling 25 having an nominal pipe diameter smaller than the nominal pipe diameter of the drop nipple 21, with the outside diameter of the reducing coupling 25 being the same size as the outside diameter of the drop nipple 21. Then the reducing coupling 25 is welded to the drop nipple 21 to form an integral drop nipple-reducing coupling assembly 29. The drop nipple-reducing coupling assembly 29 is manufactured in the factory and shipped to the job site where it is installed prior to the installation of the ceiling tile.

At the job site, the top portion of the drop nipple 21 is screwed into the outlet tee 17*a* of the branch pipe 17 prior to the installation of the ceiling 13.

After the sprinkler system is roughed in and upon installation of the ceiling tile, a hole 35 is formed in the ceiling tile 15 and the drop nipple-reducing coupling assembly 29 is inserted through the hole 35 in the ceiling tile 15 to allow the sprinkler to protrude below the ceiling tile. The hole 35 in the ceiling tile 15 is then concealed by pushing an escutcheon fitting 33 over the drop nipple-reducing coupling assembly 29 and sliding it up until it fits flush against the ceiling tile 15.

Because the ceiling tile 15 is not parallel to the floor or the real ceiling itself, each escutcheon fitting 33 and drop ceiling tile 15 intersect the polished portion of each assembly 29 at a different point. It is this feature which precludes having the sprinkler apparatus installer cut the drop nipples at the job site to allow the escutcheon 33 to fit flush to the ceiling tile 15.

The escutcheon fitting 33 is preferably made of 25 gage thick bright finish steel with a finish of zinc plate 0.003 minimum thickness and clear chromate. Escutcheon fitting 33 comprises a cylindrical body 33*a* with a flange 33*b* flaring outwardly from a bottom end 33*c* of the body 33*a* to conceal the hole 35 in the ceiling tile 15.

Three dimples 37 are equally spaced 120° apart around the top end 33*d* of the cylindrical body 33*a* for holding the escutcheon fitting 33 in place on the integral drop nipple-reducing coupling assembly 29.

What is claimed is:

1. Fire sprinkler apparatus (11) for use with a drop ceiling (13) of suspended tile (15) or sheetrock having a branch or run pipe (17) extending horizontally parallel to and positioned above the ceiling (13), and a sprinkler head (26) connected to said branch or run pipe (17) by a drop nipple-reducing coupling assembly (29), said assembly (29) comprising a drop nipple (21) with threads (23) formed on its upper end (21*a*) on the outside surface of the drop nipple (21) connected to a connecting tee 17*a* and having a bottom end (21*b*), said drop nipple (21) being a pipe, a reducing coupling (25) having an upper end (25*b*), mounted on the bottom end (21*b*) of the drop nipple (21) in abutting relationship, with the outer surface (25*a*) of the reducing coupling (25) and outer surface (21*c*) of the drop nipple (21) being in alignment with each other to form a smooth outer surface of the same circumference for the nipple and the coupling and to form an integral drop nipple-coupling having the outside appearance of a integral pipe, a weld (27) joining the surface of the upper end (25*b*) of the reducing coupling (25) to the surface of the bottom end (21*b*) of the drop nipple (21) to form an integral drop nipple-reducing coupling assembly (29) with a smooth, uniform outer surface, and the outer circumference of the reducing coupling (25) being the same size as the outer circumference of the drop nipple (21).

2. The fire sprinkler apparatus of claim 1, including an escutcheon fitting (33) which slides over the combined integral drop nipple-reducing coupling assembly (29) for a predetermined distance until it is flush with the bottom surface of the tile (15) to form a friction fit with the outer surface of the combined assembly (29), said escutcheon forming a friction fit with the combined integral drop nipple-reducing coupling assembly whether the escutcheon is positioned around the drop nipple portion or around the reducing coupling portion of the integral pipe nipple-reducing coupling.

3. The fire sprinkler apparatus of claim 1, the ceiling tile (15) having a hole (35) in it, the integral drop nipple-reducing coupling assembly (29) extending through the hole (35) without being mounted on the ceiling tile, and with a sprinkler head (26) threaded onto the combined integral drop nipple-reducing coupling assembly (29).

4. An integral combination pipe drop nipple and reducing coupling assembly (29) comprising a drop nipple (21) with threads (23) formed on its upper end (21*a*) for connecting to a branch or run pipe (17), said drop nipple (21) having a nominal pipe diameter, a reducing coupling (25) having the same outside pipe diameter as the drop nipple and having an inlet port (25*d*) and an outlet port (25*e*), the inner diameter of the reducing coupling (25) being smaller in diameter than the inner diameter of the drop nipple (21), a circular ridge (25*f*) extending from the upper end surface (25*b*) of the reducing coupling (25) which is welded between the upper end surface (25*b*) of the reducing coupling (25) and the bottom end surface of the drop nipple (21), and a weld (27) connecting the top surface of the reducing coupling (25) to the bottom surface of the drop nipple (21) to form an integral drop nipple-reducing coupling assembly (29) with a smooth outer surface of the same circumference for the drop nipple and the coupling.

5. The coupling assembly of claim 4, including a sprinkler head (26) mounted on said reducing coupling the inner circumference of the reducing coupling (25) having threads formed thereon, and the outer circumference of the sprinkler head (31) having outer threads which screw into the inner threads of the reducing coupling (25).

6. A method of making and using a combination drop nipple and reducing coupling assembly (29) for use in a fire sprinkler apparatus (11) above a drop ceiling (13) of ceiling tiles (15) comprising the steps of selecting a pipe of suitable size to form a drop nipple (21), cutting threads (23) into an upper portion of the drop nipple (21) suitable for connecting the drop nipple (21) to a branch or run pipe (17), selecting a reducing coupling (25) having an inside diameter smaller than the inside diameter of the drop nipple (21), selecting a drop nipple (21) and a reducing coupling (25) having the same size outer circumference and with a circular ridge (25*f*) extending from the upper end surface (25*b*) of the reducing coupling (25), welding the reducing coupling (25) to the drop nipple (21) by melting the circular ridge (25*f*) to form an integral drop nipple-reducing coupling assembly (29) having a uniform outer circumference, polishing the outside circumference of the integral drop nipple-reducing coupling to make the combination drop nipple and reducing coupling assembly appear to be seamless, attaching the top portion of the drop nipple (21) to the branch or run pipe (17), it forming a hole (35) in a ceiling tile (15), and inserting the drop nipple-reducing coupling assembly (29) through the hole (35) in the ceiling tile (15).

7. The method of claim 6, including concealing the hole (35) in the ceiling tile (15) by inserting an escutcheon fitting (33) over the drop nipple-reducing coupling assembly (29) flush against the ceiling tile (15).

* * * * *